US005442986A

United States Patent [19]

Cota

[11] Patent Number: 5,442,986

[45] Date of Patent: Aug. 22, 1995

[54] INTEGRATED COLLAPSIBLE GUITAR, SOUND STUDIO AND CASE

[76] Inventor: Jose G. Cota, 2928 E. La Marche, Phoenix, Ariz. 85032

[21] Appl. No.: 247,639

[22] Filed: May 23, 1994

[51] Int. Cl.[6] ..... G10D 1/08

[52] U.S. Cl. ..... 84/267; 84/291; 84/726

[58] Field of Search ..... 84/267, 291, 327, 725, 84/726

[56] References Cited

U.S. PATENT DOCUMENTS

| | | | |
|---|---|---|---|
| 3,396,621 | 8/1968 | Dycus | 84/293 |
| 4,191,085 | 3/1980 | Litwin | 84/293 |
| 4,334,452 | 6/1982 | Morrison, III et al. | 84/291 |
| 4,632,002 | 12/1986 | Clevinger | 84/291 X |
| 4,873,908 | 10/1989 | Moore | 84/291 |
| 4,995,292 | 2/1991 | Nomura | 84/726 |
| 5,058,479 | 10/1991 | Shaw | 84/291 |
| 5,315,910 | 5/1994 | Soupios | 84/453 |

*Primary Examiner*—David M. Gray
*Assistant Examiner*—Patrick J. Stanzione
*Attorney, Agent, or Firm*—Richard R. Mybeck; Peter B. Scull

[57] ABSTRACT

A collapsible stringed instrument which is integrated into a compact carrying case with a portable sound studio. This instrument is collapsible by sliding the fretboard along channels in the body of the instrument inwardly or toward the rearward face of the case to retract or collapse the instrument for carrying. This instrument is extendible by following the reverse process. A novel, removable multiple coil pickup is included which plays at a normal electric tone or pitch, or at a combined, different tone or pitch by alternately lifting open or lowering to close the hinged top portion thereof. Said portable sound studio has a compact disc (CD) player, cassette tape player/recorder, and a special effects circuitry board for amplifying, mixing and altering sounds. An alternative embodiment of the present invention includes a "Hummingbird" fretboard having frets with ridges cut therein and which ridges generally decrease in size and shape in direct correspondence to guitar string size and shape.

22 Claims, 3 Drawing Sheets

INTEGRATED COLLAPSIBLE GUITAR, SOUND STUDIO AND CASE

INTRODUCTION

The present invention relates generally to collapsible, self-contained musical instruments and portable sound studios and more particularly involves a novel and unique collapsible guitar having interchangeable, extendible fretboards, and a removable, simply switchable electromagnetic pickup configuration integrated into a single compact carrying case with a sound studio capable of creating multiple sound effects, and playing or recording prerecorded compact disc (CD) or cassette music alone or with the guitar.

BACKGROUND OF THE INVENTION

Music has nearly always provided a popular source of entertainment and pleasure to persons from all walks of life. However, many of these people, particularly musical entertainers, need easily transportable, compact musical instruments and sound systems. Thus, there exists a continual need for innovative, collapsible, and portable musical instruments and sound studios.

Many different attempts have been described in the prior art to achieve some of these goals. Very early efforts include Mustill (U.S. Pat. No. 350,693) which teaches a banjo with a neck portion that folds toward and fits against the back of the body portion for storage. Another is Middlebrooke (U.S. Pat. No. 519,409) which teaches a banjo having a neck portion that folds over the top body portion for storage. Further, Gassin (U.S. Pat. No. 2,803,982) teaches a bass violin with a detachable neck/string portion and a separate case for storage.

Later efforts include Copeland (U.S. Pat. No. 3,910,151) which teaches an electronic guitar having collapsible body sections and neck and string attach/adjust portions which pivot to shorten the length dimension for easy storage.

Jorgensen (U.S. Pat. No. 4,073,211) teaches a collapsible stringed instrument wherein the neck portion of an electric guitar pivots to fit into a shaped recess in the back of the body portion.

Field (U.S. Pat. No. 4,111,093) teaches a stringed instrument having a foldable neck portion which pivots to rest against the back of the body portion and further has a geared string mounting block to allow partial loosening of the strings thereby preventing the strings from becoming tangled or kinked while stored.

Litwin (U.S. Pat. No. 4,191,085) teaches an acoustic guitar (or other such instrument) where the neck portion disassembles to fit into the acoustic body portion of the instrument for storage.

Bunker (U.S. Pat. No. 4,201,108) teaches a solid body electric guitar having a steel rod in the neck to avoid warping and removable "snap-on" wings forming an extended guitar body.

Clevinger (U.S. Pat. No. 4,632,002) teaches a collapsible electric double bass having a hinged foot portion which pivots up under the top body portion and also discloses an innovative incorporation of a piezoelectric bridge pickup element.

Kamal (U.S. Pat. No. 4,638,708) teaches an acoustic guitar having a detachable neck portion or alternatively a pivotable neck portion which can be pivoted over the front of the body portion to facilitate storage.

Shaw (U.S. Pat. No. 4,686,882) teaches an acoustic guitar having a folding, collapsible body comprised of two hinged wings and a neck portion that hinges to pivot over the top body portion.

Mastroianni (U.S. Pat. No. 4,770,079) teaches a collapsible stringed musical instrument such as an electric guitar having bars or supports which pivot out from underneath an elongated body to simulate portions of the outline of a full-sized instrument.

Moore (U.S. Pat. No. 4,873,908) teaches a collapsible solid body electric guitar in which the string attachment, neck and pickup/control portions detach from the body portions. The body portions swivel to form a longer, narrower piece and the pickup/control section is hinged to swing away from the string attachment body portion to form a more compact storage module.

Buscarino (U.S. Pat. No. 4,982,640) teaches a collapsible electric guitar with a releasable neck portion threadedly attached to the body with at least one mortise/tenon coupling.

In addition to the need for improved collapsible stringed instruments, modern musicians also want electronic control of the sounds generated thereby. Electromagnetic pickup elements that detect the mechanical vibrations of the strings and convert these to electrical signals that can be amplified and projected by conventional amplifiers and speakers are well known to those with ordinary skill in the art. Also well known, is the use of multiple pickup elements placed in various configurations on a guitar to generate different tonal sounds because when placed in disparate locations relative to the strings the pickup elements obtain distinct frequency components of the mechanical string vibrations. Moreover, musicians are able to switch from one to another of these pickup elements during play or to switch to combinations of two or more pickups to provide a plurality of electrically amplified guitar sounds. Two electromagnetic coils may also be combined in a single double-coil pickup element to provide what is called a "humbucking" sound or a heavier sound than that produced by conventional single-coil pickup elements.

One recurring problem noted in the prior art is the inability to quickly and accurately switch from one to another of the multiple pickup elements while also continuing to play the guitar. Improvements in pickup switching technology include Starr (U.S. Pat. No. 4,711,149) which teaches an electronic push button switching system that allows rapid, unobtrusive switching between multiple pickup elements or combinations thereof in an electric guitar and thereby provides the musician simple and accurate switching control during play, such as was not heretofore available using conventional mechanical switches.

Regarding innovative sound studio designs, Aker (U.S. Pat. No. 3,812,278) is significant in that it teaches electronic circuitry for a sound amplifier that includes circuitry for creating special tonal effects in electrical musical instruments. As such, Aker is exemplary of conventional amplifier/mixer/special effects circuitry boards like that employed in the present invention. The other components generally included in sound studios, such as compact disc (CD) players and AM/FM cassette tape players and recorders, are also well known in the art, and no electrical improvements thereof are intended herein.

Accordingly, in spite of the various efforts of the prior art, a need still exists for a truly useful and improved integrated guitar case assemblage comprising a novel collapsible guitar wherein the neck and fretboard slidably move within corresponding channels in the guitar body such that they do not merely detach or pivotally fold under or over the guitar body. A need also persists for removable and interchangeable pickup configurations (or combinations of pickup elements) that facilitate greater switching control from one to another or more pickup elements during play. An additional want left unfulfilled by prior art designs is that for an integrated guitar case assemblage that also has a built-in sound studio comprising a tape recorder/player, an audio compact disc (CD) player and electrical means for providing special audio effects. Further, such guitar case assemblage should be closable to envelop the collapsed guitar and sound studio within a single, protective, compact carrying case.

BRIEF SUMMARY OF THE INVENTION

The present invention provides a new and unique collapsible guitar and a portable sound studio integrally combined within the same compact carrying case. This guitar case assemblage comprises a collapsible guitar integrally formed within one side portion of the case assemblage and a sound studio, including a compact disc (CD) player, an AM/FM cassette tape player/-recorder, and an amplifier/mixer/special sound effects circuit board integrally formed within the second side portion.

The guitar side portion comprises interchangeable, slidable fretboards that alternately extend to playing position, or retract within the guitar body so that the case assemblage may be closed for storage or carrying. The interchangeability of the fretboards allows for the creation of what is effectively a plurality of instruments in one case; a fact which is particularly so when a novel "Hummingbird" or ridged fretboard is used. Further included are standard guitar strings, a tailpiece bridge with tuning knobs, a hollow opening under the guitar body for storage, and either a practice pickup or a new and unique multiple pickup configuration with a built-in automatic tuner. The multiple-coil pickup of the preferred embodiment has four electromagnetic coils and three built-in sound modes, the toggling or switching between two of which is achieved by simple pivoting or rotation of the hinged top portion over the guitar strings and base portion. When open and plugged into battery power (or other electric power), it plays at normal electrical guitar sound levels as provided by a standard two-coil pickup element, and when pivoted to closed position, sound amplification is changed in tone due to mechanically switching "off" the two-coil element and simultaneously switching "on" a combination of two single-coil elements. If not plugged into battery power, the open position provides a simple, clear amplification as produced by one of the aforementioned single-coil elements. Lastly, a fourth sound mode may be achieved when the guitar sounds are altered or modified by mixing them through the sound effects amplifier/mixing board.

Accordingly, the primary object of the present invention is to provide a collapsible guitar and sound studio, both integrally formed within a single compact carrying case.

Another object of the present invention is to alternately extend or contract the collapsible guitar of such a case through means of a slidable neck and fretboard combination that slides along channels in the body of the guitar while the removable tailpiece bridge with tuning knobs is alternately slid into the slide channels or placed inside the hollow storage area.

Yet another object is to create a plurality of convertible stringed instruments in one assemblage by interchanging fretboards of different sizes and with different fret shapes to form a plurality of sounds.

A further object of the present invention is to integrate within such a novel guitar carrying case a compact sound studio having a plurality of sound equipment such as a compact disc (CD) player, a cassette tape player/recorder, and an amplifier/mixing circuitry board with circuitry capable of producing multiple sound effects.

A still further object is to provide removable, interchangeable electromagnetic pickup configurations, one of which is a single or double coil practice pickup configuration and the other, a unique multiple coil pickup configuration that is simply switchable from one to another pickup element or combination of the multiple pickup elements during guitar play to quickly and easily produce alternate electric tonal sounds or levels by simple rotatable manipulation of a hinged top portion relative to a base portion.

These and still further objects, as shall hereinafter appear, are readily fulfilled by the present invention in a remarkably unexpected manner as will be readily discerned from the following detailed description of an exemplary embodiment thereof especially when read in conjunction with the accompanying drawings in which like numbers bear like indicia throughout the several views.

DESCRIPTION OF PREFERRED EMBODIMENT

The present invention relates generally to portable music systems and more particularly to a fully integrated, compact guitar carrying case with a built-in collapsible guitar and integrally attached sound studio.

Figure 12:
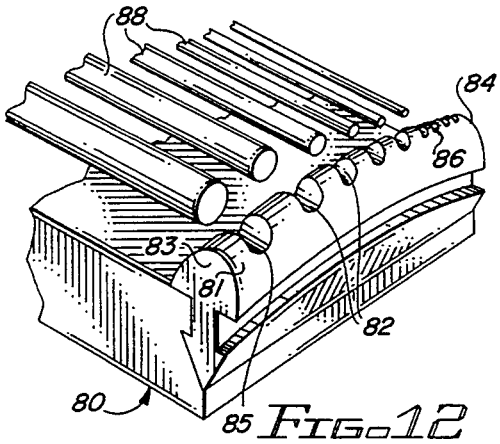
FIG. 12 is an enlarged, fragmented isometric view of the fretboard and strings of an alternative embodiment of the present invention.
Figure 13:
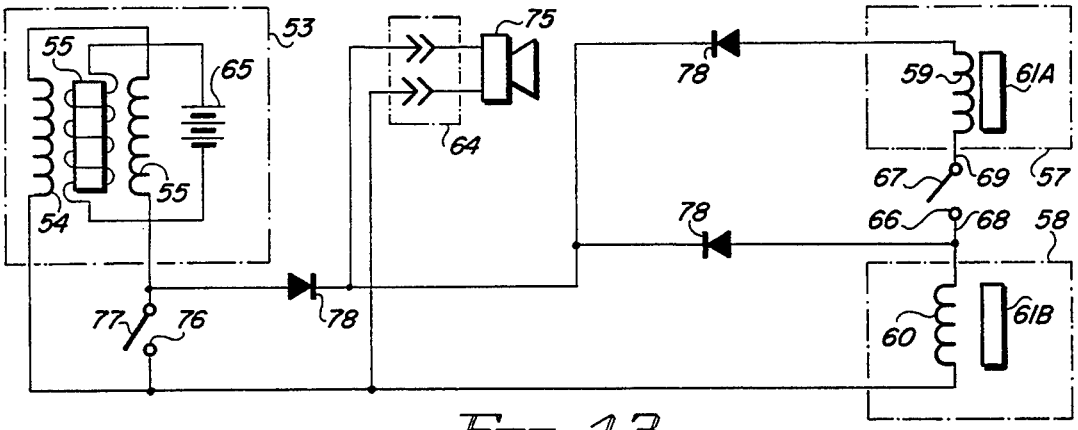
FIG. 13 is a circuit diagram of the multiple coil pickup configuration of FIGS. 7–10.
Figure 14A:
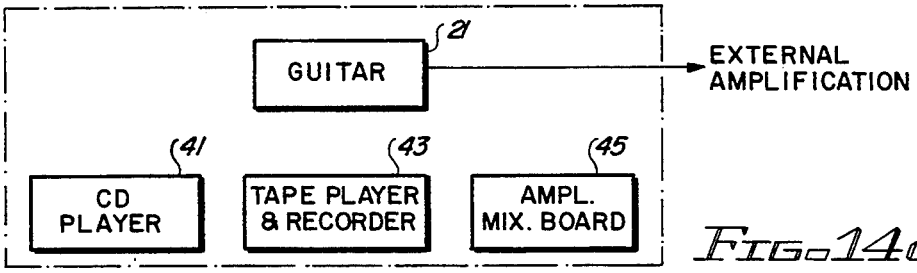
FIGS. 14 (*a*)–(*g*) are block diagrams showing a plurality of playing combinations of a guitar case assemblage embodying the present invention.
Figure 14B:
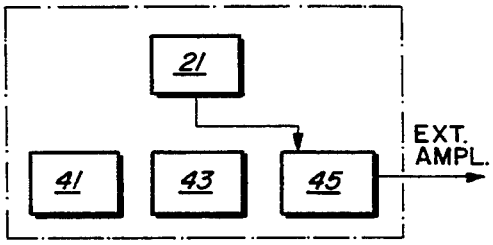
Figure 14E:
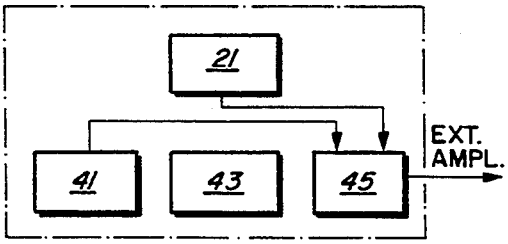
Figure 14C:
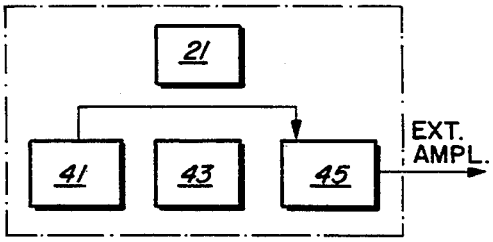
Figure 14F:
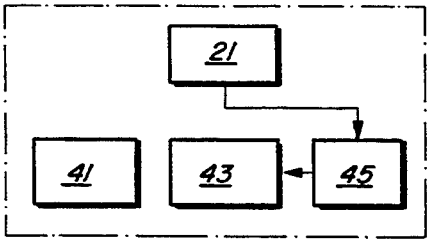
Figure 14D:
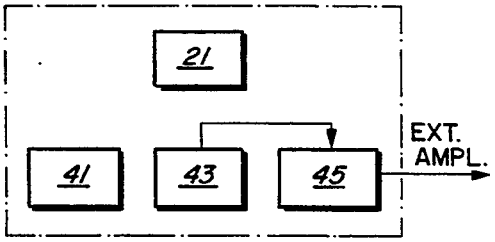
Figure 14G:
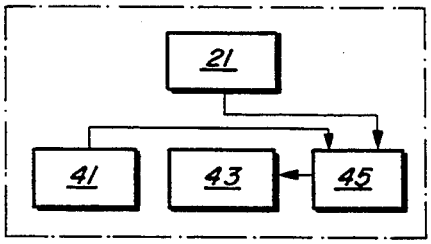

Referring to the drawings, FIGS. 1–6 depict one embodiment of a guitar case assemblage 10 of the present invention and FIGS. 7–11 show alternative removable pickup configurations for use with assemblage 10. FIG. 12 shows an alternative embodiment of the present invention and FIGS. 13 and 14 show circuit and block diagrams respectively.

Figure 1:
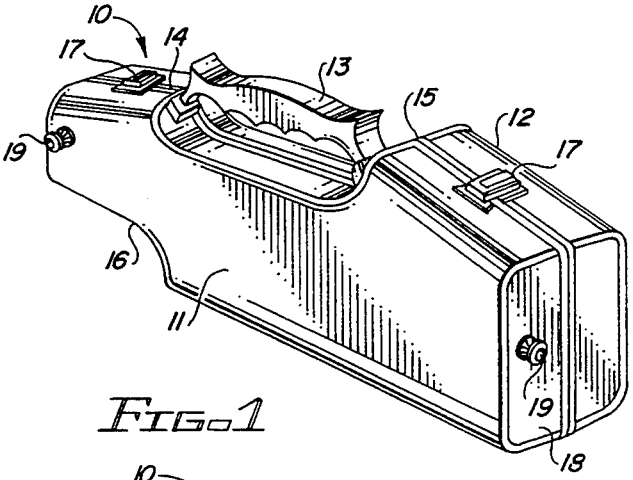
FIG. 1 is an isometric view of a closed guitar case assemblage embodying the present invention.

In the preferred embodiment, FIG. 1 shows a guitar case assemblage 10 of the present invention in closed position. Assemblage 10 comprises first and second side portions 11 and 12 and a handle 13. Side portions 11 and 12 are each roughly rectangular in shape (as viewed from the side) with two inclined peaks 14, 15 rising slightly to meet each end of handle 13. Another variation from the basic rectangular shape is the inclusion of a concave indentation 16 that, as will become further evident below, facilitates fingering the fretboard during play.

FIG. 1 also shows that assemblage 10 is held in closed position by means of conventional clasps or latches 17 which include, in the preferred embodiment, hinged latches fixed to side portion 12 which pivot over and clasp corresponding posts fixed to side portion 11. Further, each side portion 11 and 12 has a forward face (not shown) and a rearward face 18. Guitar strap posts 19 are located on first side portion 11, one on rearward face 18 and the other near the forward face of side portion 11 as shown in FIG. 1. First and second side portions 11 and 12 are attached to each other by means of hinge connections 20 which are not visible in FIG. 1, but are however, more clearly depicted in the open views of case assemblage 10 as shown in FIGS. 2–6. Assemblage 10 is alternately opened and closed by rotating one of the side portions relative to the other about hinge connections 20.

Figure 2:
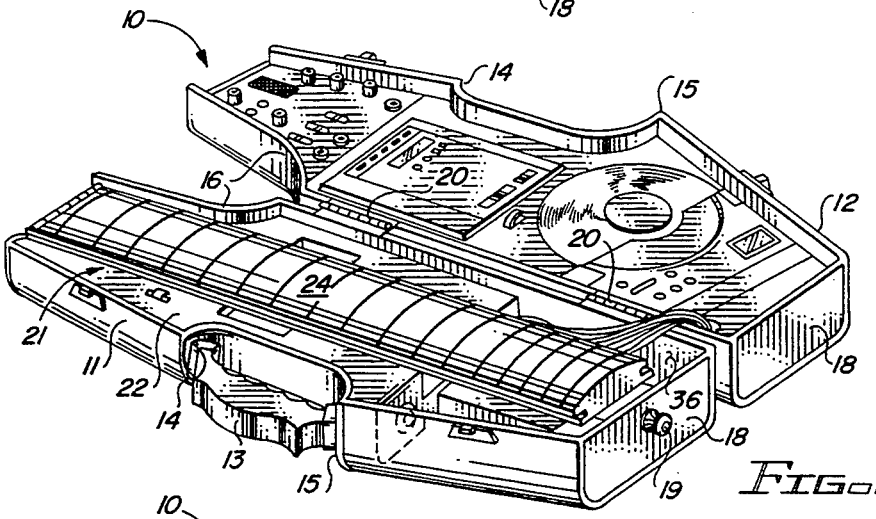
FIG. 2 is an isometric view of an opened guitar case assemblage embodying the present invention with the guitar in fully collapsed or retracted position.
Figure 3:
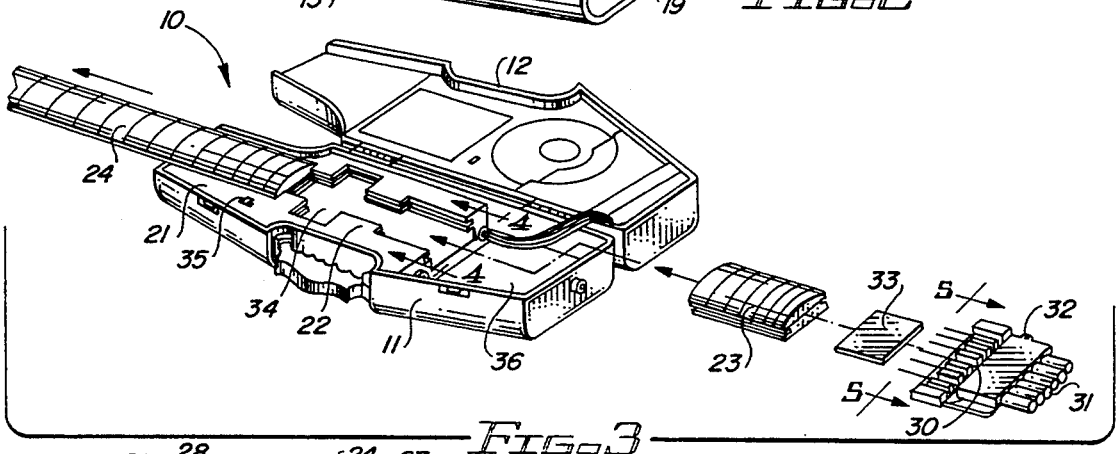
FIG. 3 is an exploded, partially fragmented view of the open guitar case assemblage of FIG. 2 with the fretboard slid outward into extended position, and the tailpiece bridge and other guitar components removed.
Figure 4:
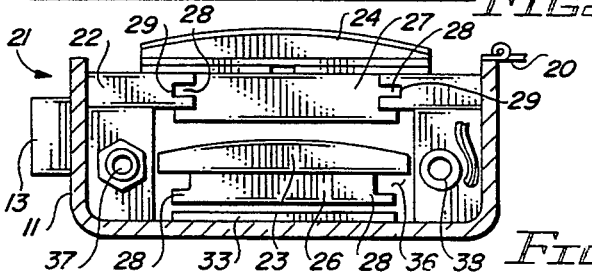
FIG. 4 is a cross-sectional, partially fragmented view of the guitar case assemblage taken on line 4—4 of FIG. 2.
Figure 5:
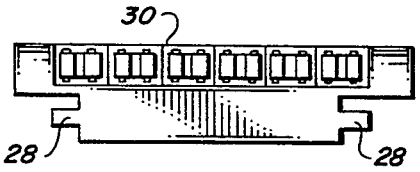
FIG. 5 is an elevational view of the tailpiece bridge taken on line 5—5 of FIG. 2.
Figure 6:
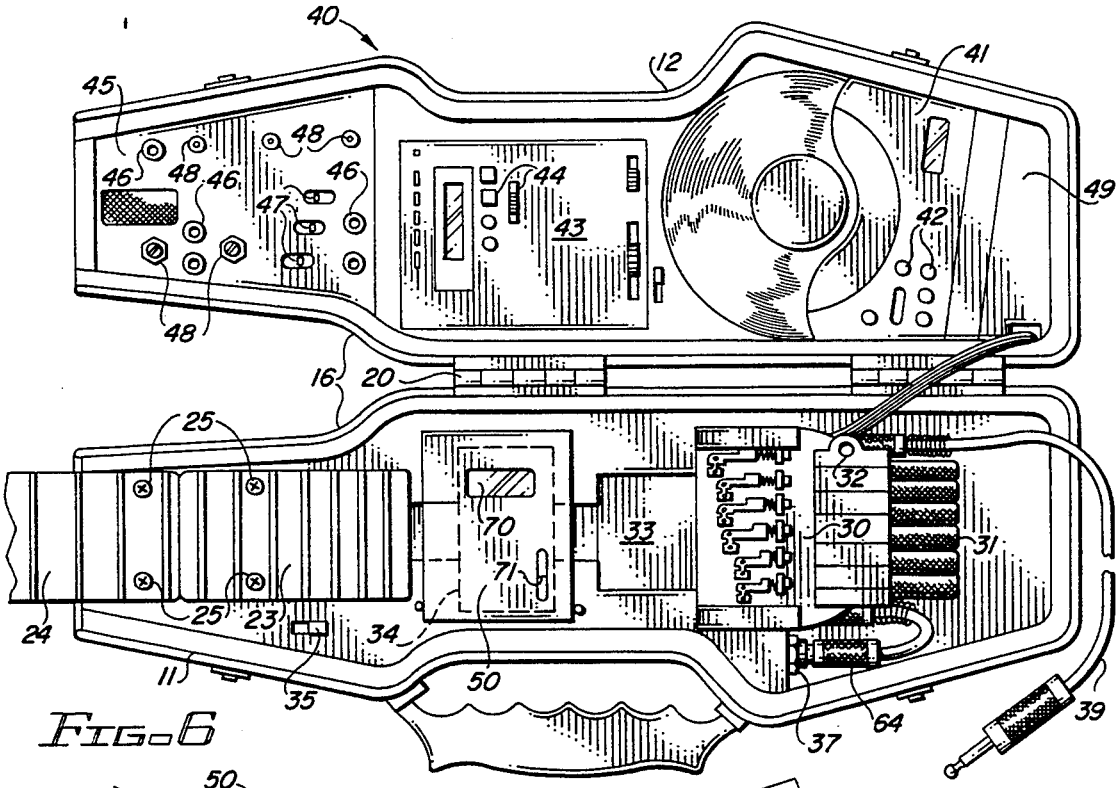
FIG. 6 is a partially fragmented, elevational view of an open guitar case assemblage embodying the present invention with the guitar in fully extended, ready to play position.

As is also shown in FIGS. 2–6, first side portion 11 has guitar 21 integrally formed therein. As further described below, guitar 21 is alternately collapsible or retractable to the fully retracted position shown in FIG. 2 and extendible as shown in FIGS. 3 and 6. The primary components of guitar 21 are guitar body 22 integrally built into side portion 11, removable short fretboard member 23, and slidable long fretboard member 24. Each of these fretboard members are fastened to guitar body 22 by removable fastening screws 25 which are shown more clearly in FIG. 6. As shown best in FIG. 4, both fretboard members 23 and 24 are rigidly attached to aluminum neck members 26, 27 which have flanges 28 that extend along the length of fretboard members 23 and 24. Flanges 28 are sized to slidably fit in corresponding slide channels 29 which are integrally formed in guitar body 22. It is along slide channels 29 that neck members 26, 27 and thus fretboard members 23 and 24, are moved or slid so that guitar 21 is alternately extended to the open position or collapsed into fully retracted position. Further, long fretboard member 24 may be completely removed by sliding it out of slide channels 29, by continuing to move it fully forward beyond the position shown in FIG. 3, and may then be replaced with a different, interchangeable fretboard member (not shown). In this way, two or more fretboard sizes may be interchanged to create different musical pitches such that, for example, a $24\frac{3}{4}$ scale fretboard may be interchanged with a $22\frac{1}{4}$ scale fretboard, etcetera. See for further interchangeability examples the description of the alternative embodiment involving the "Hummingbird" fretboard 80 below.

Conventional guitar strings (not shown in FIGS. 1–6 in order to clarify the pertinent details of the present invention) and a removable tailpiece bridge 30 with tuning knobs 31 are also primary component members of guitar 21. The guitar strings are connected in a conventional manner, one end of each is connected to the distal end of long fretboard member 24 while the other end of each is connected to each of the individual tuning knobs 31 which are rotatable in the traditional fashion to tune each of the individual guitar strings. Threaded hole 32 is provided in tailpiece bridge 30 to receive a conventional whammy bar (not shown) if desired. An elevational view of tailpiece bridge 30 showing flanges 28 for insertion in slide channels 29 is shown in FIG. 5. A final, primary element of guitar 21 is removable multiple or four-coil pickup configuration 50 which is shown as attached to guitar 21 in FIG. 6 and is described in detail below (other removable pickup configurations, including practice pickup 72 which is also described below, may alternatively be attached to guitar 21 depending upon which pickup configuration may be desired at any given time ).

As shown more clearly in FIG. 3, other parts of guitar 21 include slidable insert 33, pickup receiving cavity 34, and spring loaded latch hook 35. Slidable insert 33 is sized so as to be inserted in slide channels 29 in the space between tailpiece bridge 30 and pickup receiving cavity 34. Spring loaded latch hook 35 is located inside slide channels 29 such that the spring loaded hook (not shown) engages neck 27 of long fretboard member 24 so as to hold member 24 in extended playing position until screws 25 are removed and latch hook 35 is released. The purpose of latch hook 35 is to facilitate the process of extending guitar 21 to playing position by holding long fretboard member 24 in extended position while removable fastening screws 25 are installed or removed.

As shown particularly in FIGS. 2 and 4, a hollow open storage space 36 is located under guitar body 22 in side portion 11 for receiving removable short fretboard member 23, slidable insert 33 and tailpiece bridge 30 when guitar 21 is collapsed for closing assemblage 10. Pickup receiving cavity 34 directly communicates with storage space 36 (as shown in FIG. 3) for purposes to be described below. Also located in storage space 36 are input and output jacks 37 and 38, respectively. Lead 39, which connects to external amplification (not shown), is plugged into output jack 38, while either of leads 64 or 74 from either four-coil pickup 50 or practice pickup 72 is plugged into input jack 37.

Sound studio 40 is shown in FIGS. 2 and 3 but is set forth in greater detail in FIG. 6. Sound studio 40 is integrally formed within second side portion 12 of case assemblage 10. A conventional compact disc (CD) player 41, a conventional cassette tape player/recorder 43 (that may alternatively also have an AM/FM tuner), and a mixer/amplifier/sound effects circuitry board 45 of a type similar to those known in the prior art, are the major component elements of sound studio 40. CD player 41 has control buttons 42 and cassette tape player/recorder 43 has control buttons 44. Mixer/amplifier/sound effects board 45 has output jacks 46 to connect guitar 21, CD player 41, cassette tape player/recorder 43, or sound effects board 45 to external amplification or headphones (both not shown). Mixer/amplifier/sound effects board 45 also has control switches 47 and knobs 48 for mixing and creating sounds. Further, all of these elements of sound studio 40 are preferably battery operated and such batteries are connectable to the appropriate battery terminals (not shown) which are contained in battery compartment 49.

A novel and unique, removable multiple coil pickup configuration 50 is described in the preferred embodiment and shown in FIGS. 6–10 as having four coils. This refers to the number of electromagnetic "coils" of usually copper wire set in a magnetic field which are incorporated into this embodiment of the present invention. It is understood that although it is described as such, pickup configuration 50 may have any number of multiple pickup elements. Removable four-coil pickup configuration 50 is shown in "open" position in FIG. 7 and in "closed" position as attached to guitar 21 in FIG. 6 and as positioned relative to guitar strings in FIG. 8.

Figure 7:
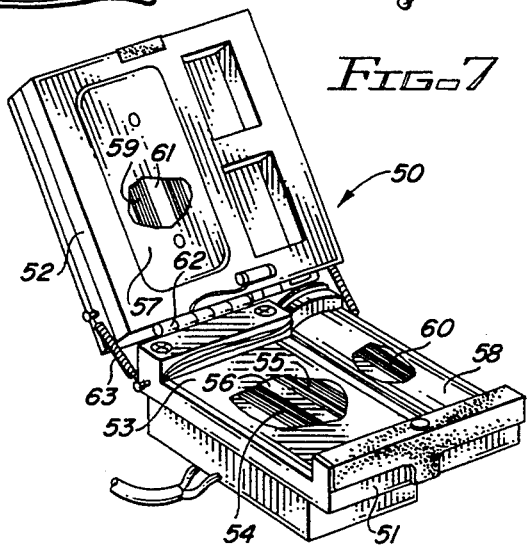
FIG. 7 is an isometric view of an open multiple coil pickup configuration of the present invention.

Four-coil pickup 50 comprises a base portion 51, and a hinged top portion 52. A standard double-coil pickup element 53 is located in base portion 51 and provides standard humbucking amplification (a battery powered preamplifier is also built into element 53 to help create the conventional humbucking sound). Element 53 comprises two copper wire coils 54, 55 placed in a magnetic field established by magnet 56 (which could also be an electrically charged electromagnet) as shown in FIG. 7. A plurality of alternative pickup element configurations is foreseeably substitutable in the space occupied by element 53, including two or more single-coil elements replacing the double-coil element 53 just described.

Figure 8:
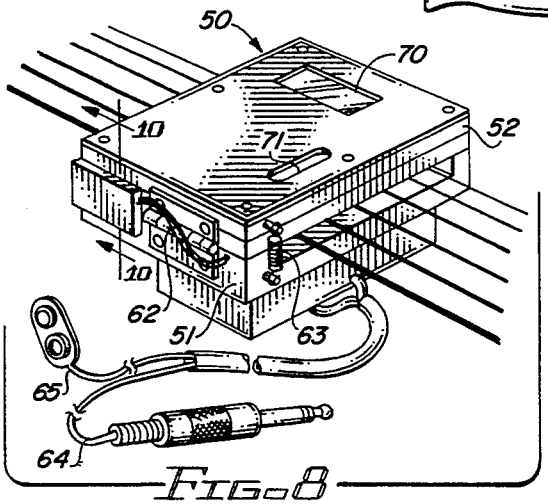
FIG. 8 is another isometric view, from a different point of reference, of a closed multiple coil pickup configuration of the present invention shown relative to the guitar strings.

FIG. 7 also shows that four-coil pickup 50 further comprises a unique combination of a single-coil pickup element 57 located in top portion 52 with a reverse wound single-coil pickup element 58 located in base portion 51; a combination which produces a wholly different tone and/or a reduced amplification level than that of double-coil element 53. Each element 57, 58 comprises a single copper wire coil 59, 60 set in separate magnetic fields produced by permanent magnets, such as magnet 61 interposed inside coil 59. The alternative tone or amplification level occurs when four-coil pickup 50 is put in "closed" position as shown in FIGS. 6 and 8. The switching of four-coil pickup 50 from "open" position to "closed" position, which in turn switches from humbucking mode to the alternative tone amplification mode, is accomplished by simple hand rotation of top portion 52 down to (or to switch back to humbucking mode; up from) base portion 51 about hinge 62. Top portion 52 is held in either position by springs 63.

In the preferred embodiment, the placement of the various pickup elements, 53, 57 and 58 is as follows. Double-coil element 53 is situated as shown in FIG. 7 so that when properly inserted in guitar 21 it is between tailpiece bridge 30 and reverse coil element 58. Standard coil element 57 in top portion 52 is situated so that it is directly above double-coil element 53 when pickup 50 is closed. When situated in this manner, reverse polarity element 58 will pick up the higher frequency sound components of the vibrating strings so that it produces a "superclear" tone. The other coil elements, 53 and 57 pickup lower or more "bassy" tone components. Thus, highly desirable, distinct tone combinations will be generated by the different elements. Particularly, the combination of tones obtained by the addition of the "superclear" tone of reverse polarity element 58 with the "bassy" or "rhythm"-like tone of element 57 is particularly desirable and also avoids a feedback or scream which would be generated by situating single-coil elements 57 and 58 too close to each other.

As shown in FIG. 8, four-coil pickup 50 further comprises output lead 64 and nine-volt battery lead 65. Battery lead 65 is for the preamp and/or the electromagnet 56 described above. Lead 64 is insertable in guitar input jack 37 (via the direct communication opening between cavity 34 and storage space 36) to transfer the guitar sounds from four-coil pickup 50 through lead 64 to input jack 37. From input jack 37, these sounds can then be connected to external amplification (not shown) via output jack 38 and lead 39 as shown in FIG. 6. Alternatively, these sounds can be routed from input jack 37 through internal circuitry (not shown) to amplifier/mixer/special effects circuit board 45 for mixing with special sound effects from board 45 or with sounds from CD player 41 or tape player 43 as will be described in further detail below.

Figure 9:
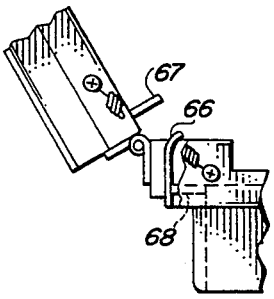
FIG. 9 is a fragmented, partially cut-away elevational view of the pickup configuration of FIG. 8 taken on line 10—10 and shown in open position.
Figure 10:
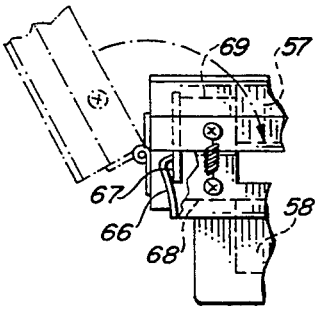
FIG. 10 is a view of the pickup configuration of FIG. 9 shown in closed position.

FIGS. 9 and 10 show a partial side view of the switching mechanism of four-coil pickup 50. The principal elements of such a switching mechanism include a conductive spring member 66 in base 51 and conductive contact member 67 in top portion 52. Contact (or lack thereof) of these elements to each other constitutes the "switch". Each of these elements is shown in FIG. 10 as connected to respective pickup elements 58 and 57 by leads 68 and 69. When positioned as shown in FIG. 7, no contact is made and effectively only element 53 generates an output sound. However, when closed as shown in FIG. 8, element 53 is short-circuited, and the combination of elements 57 and 58 is switched on. The detailed operation of configuration 50 is discussed further below.

An automatic tuner 70 may also be built into pickup 50 as shown in FIGS. 6 and 8. Tuner 70 is of a conventional type used to tune the guitar strings (not shown) and may require a battery (also not shown). A simple on/off switch 71 is used to operate tuner 70.

Figure 11:
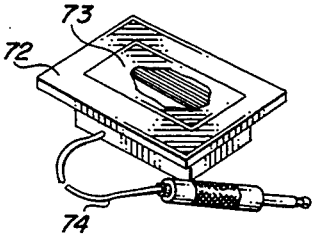
FIG. 11 is an isometric view of a practice pickup configuration of the present invention.

FIG. 11 shows a practice pickup 72 which may alternatively be used with guitar 21. Practice pickup 72 is also removable and comprises a standard single-coil (or double-coil with no preamp) element 73 and a lead 74 which is connected to guitar 21 in a manner similar to that described for four-coil pickup 50 above.

FIG. 12 depicts an alternative embodiment of the present invention and shows what is herein referred to as a "Hummingbird" fretboard 80 which may be used in lieu of fretboard members 23 and 24 to give a different instrument sound. The frets, shown here by a representative fret 81, having first and second ends 83 and 84, have a plurality of ridges 82 shown here progressively changing in size from deep, wide ridges 85 at first end 83 to shallower, thinner ridges 86 at second end 84. The purpose of these distinctive frets is to provide an alternative vibratory sound when standard guitar strings 88 rub thereon as is further described hereinbelow.

All of the component parts of guitar case assemblage 10 are preferably made from relatively standard guitar, carrying case, and sound studio materials. In the preferred embodiment, resilient plastics and aluminum are used so that assemblage 10 is lightweight yet durable.

In the preferred embodiment, guitar 21 is made mostly of aluminum to prevent warping like that which occurs in many conventional wooden guitars. Fretboard members 23 and 24 are preferably made of acrylic plexiglass and have aluminum frets inserted therein. These acrylic plexiglass fretboard members 23 and 24 are permanently and firmly attached to aluminum neck members 26, 27. Flathead screws (not shown) can be used to fixedly attach fretboard members 23 and 24 to neck members 26, 27. Fretboard members 23 and 24 can be made in various lengths to represent a plurality of scales and each is completely removable and interchangeable with others of this plurality of variously sized, similarly made fretboards. See also the description of the alternative embodiment featuring "Hummingbird" fretboard 80 which is further described below.

First and second side portions 11 and 12 are first molded or otherwise formed of plastic or like material so that they have substantially the same exterior shape as case assemblage 10 shown in FIGS. 1–6. Alternatively, first and second side portions 11 and 12 are made from wood fashioned into the desired shape using nails, glue, or other conventional manufacturing techniques. The exteriors may then be covered with a suitable covering such as a leather or a leather-like material. The interior of first side portion 11 is then preferably lined with felt, crushed velvet, or a similar material suitable for cushionably receiving instrument pieces for storage.

Most of the component members of guitar 21 are made from aluminum and are preformed using conventional metal working techniques. In particular, guitar body 22 is preformed or cut such that it will fit in corresponding side portion 11 and has formed therein openings including a pickup receiving cavity 34 and slide channels 29. Neck members 26, 27 tailpiece bridge 30, and slidable insert 33 are also made of aluminum and each has flanges 28 that correspondingly and slidably fit into corresponding slide channels 29. Tailpiece bridge 30 is made to conventional specifications with a suitable tuning mechanism that includes tuning knobs 31 that are adjustable so that guitar 21 has appropriate tone and sustain. Threaded hole 32 may also be constructed into tailpiece bridge 30 for using a conventional whammy bar if desired.

The multiple component members of guitar 21 are then assembled within first side portion 11, and in a like manner, all the component elements of sound studio 40 are firmly built into second side portion 12. Guitar body 22, with slide channels 29 and pickup receiving cavity 34 previously cut therein, is preferably firmly attached in first side portion 11 with a plurality of flat-head screws (not shown). Fretboard members 23 and 24, slidable insert 33 and pre-constructed tailpiece bridge 30 with tuning knobs 3 are then inserted in slide channels 29. Standard guitar strings are attached to the distal end of long fretboard member 24, stretched over tailpiece bridge 30 and attached to tuning knobs 31.

The component members of sound studio 40 are primarily commercially available components that are integrated into an aluminum framework in side portion 12 using screws (not shown) or other conventional fastening means. It is foreseeable that depending on size requirements and functional limitations, certain adaptations to the commercial forms of the components may be required. For instance, in one embodiment of the present invention, a commercially available CD player 41 was disassembled so that only the necessary circuitry (not shown) and controls 42 were firmly integrated into side portion 12. Similarly, a commercially available AM/FM cassette player/recorder 43 that has control buttons located on multiple faces thereof was pivotally installed in side portion 12 so that player/recorder 43 may be pivoted out of and away from side portion 12 to expose the buttons for use. Amplifier/mixer/special effects circuitry board 45 is likewise a commercially available unit that may have to be dimensionally adapted before it can be installed in side portion 12. For example, it may be cut in size to fit the area reserved therefor in side portion 12 where it may be covered with an aluminum faceplate. Further, each of the sound studio components (or the guitar) may be hard wired to inputs on board 45 for mixing, and an output may be wired back to tape recorder 43. The power lines (not shown) for all sound studio components should then be wired to battery compartment 49, which is also covered with a removable aluminum faceplate.

The final component member of the preferred embodiment of guitar 21 to be made and inserted in the preferred embodiment thereof is removable four-coil pickup configuration 50. This may be made from aluminum or other suitable materials that do not interfere with its electromagnetic operation. Base portion 51 is built to contain a standard double-coil humbucking pickup element 53 (with a preamp, not shown) and a reverse polarity (or reverse wound) single-coil pickup element 58 in substantially parallel relationship as shown in FIG. 7. Top portion 52 is built to contain a standard polarity pickup element 57, and alternatively may contain an automatic tuner 70. The coils 54, 55 and 59, 60 used in all of the pickup elements of the preferred embodiment are generally made of copper wire wound around or near permanent magnets, in the manner well known to those in the art. The reverse polarity coil 58 is similar to a standard single-coil element except that the copper wire has been wound and the magnet is positioned such that an opposite or reverse polarity to that of standard coil pickup elements 53 and 57 is obtained.

Pickup elements 53, 57, and 58 are then wired to communicate their outputs to lead 64, however the manner of making these wired connections is very important in the preferred embodiment. First, standard coil element 57 is connected to reverse polarity element 58 in series so that their signals are added to each other. The effect of this standard to reverse polarity connection is a doubling of the total output (based on each coil having the same number of windings). In other words, if each element was alternatively wound in the standard manner (with the same number of windings), a connection of each together would generate effectively a single output equal in power to either of the single elements alone (i.e., one half the power of each added together to form an effective single full output of the combination sound). Rather, the present embodiment connecting the forward and reverse polarity elements together demonstrates the addition of the outputs of two single-coil elements to form a single, combination sound with double the power output.

Further, the electrical connections of the preferred embodiment also incorporate contact switches as shown in FIGS. 9 and 10. The switching mechanism of four-coil pickup 50 resides in the contact between conductive spring member 66 in base portion 51 and conductive contact member 67 in top portion 52. The connection is completed as follows: first, one end of lead 68 is attached to reverse polarity single coil 58 and the other to conductive spring member 66; also, one end of lead 69 is connected to standard coil 57 and the other to contact member 67 in top portion 52; then, when top portion 52 is pivoted to closed position, contact member 67 deformably and fully contacts spring member 66. Members 66 and 67 thereby remain in this electrically connected position while pickup 50 is kept closed and thus allow electrical current to flow therebetween.

As described then, reverse coil 58 and single-coil element 57 are not connected until pickup 50 is closed. In fact, the preferred embodiment is wired such that reverse coil 58 is always connected to output lead 64 to continuously send an output signal whether pickup 50 is opened or closed. Of course, when closed the output signal is the combination sound of both elements as described above.

The electrical connection of the double-coil, humbucking element 53 also built into pickup 50 has an identical contact switching mechanism (not shown in FIGS. 7–10) to that described above. This switch however, serves to short circuit, or turn off, pickup 53 by shunting or effectively disconnecting the electrical signal connection between pickup 53 and output lead 64 when contact is made upon closure of top portion 52.

To assist the description of the electrical circuitry involved in pickup configuration 50, a circuit diagram is provided in FIG. 13. Power sources in this diagram are shown as the various pickup elements 53, 57 and 58 which generate current under the principles of electromagnetic induction. The moving guitar strings disrupt the magnetic fields established by the various magnets (55, 61A and 61B) of these elements and thereby cause currents to flow in the wire coils 54, 55, and 59, 60. Ultimately, these currents flow through output lead 64 and are confronted with external resistance 75 from amplifiers and speakers or other such devices. Pickup element 53 has an associated battery lead 65 for its internal preamp and/or electromagnet which when attached to a nine-volt battery (not shown) provides the humbucking power described above.

The circuit diagram of FIG. 13 also shows the two switching mechanisms 66, 67, and 76, 77. Contact between spring members 66 and contact member 67 is described above. An identical mechanism 76, 77 which is used to short circuit element 53 also makes use of a spring member 76 and a contact member 77. Diodes 78 may also be required to prevent possible undesirable short circuits. As shown in FIG. 13, when switch mechanism 76, 77 is open, the current induced in element 53 flows in the top horizontal electrical connection from left to right through diode 78 and then to and through lead 64 and resistance 75. It then completes the circuit by flowing back to element 53 via the bottom horizontal electrical connection. However, when switch 76, 77 is closed, all of the induced current from element 53 flows through switch 76, 77 thereby short-circuiting the element 53 output and not allowing any element 53 current to present itself to lead 64 and resistance 75.

Switches 66, 67, and 76, 77 are opened and closed simultaneously. Thus, when closed, switch 66, 67 allows for the series combination of elements 57 and 58 to present their outputs to lead 64 and resistance 75. Contrariwise, when opened, switch 66, 67 allows only element 58 output to reach external amplification, however if element 53 is connected to battery power via lead 65, the element 58 output will not be audible over that of element 53.

Thus, the cumulative effect of the switches in the preferred embodiment is this: when pickup 50 is inserted in cavity 34 of guitar 21 (with a battery connected to lead 65) and in open position, both the double-coil element 53 and the reverse polarity element 58 are sending signals to output lead 64; when closed, element 53 is shut off and both single-coil elements 58 and 57 combine to send one output signal to lead 64. Of course, the practical effect of the first scenario is that the output signal from reverse coil element 58 is all but completely silenced or overpowered by the element 53 output which is then the only output effectively heard. One other scenario occurs when element 53 is physically not connected via battery lead 65 to a power supply. Here then, double-coil element 53 is effectively always "off" and the reverse coil 58 output is not hindered in any way such that it is presented in full when pickup 50 is open. When closed, there is no different effect. The element 53 switch turns off an already non-existent element 53 signal and elements 58 and 57 again combine their outputs as before.

After proper arrangement of the various pickup elements and switching mechanisms is completed, construction of the other elements of four-coil pickup 50 proceeds as follows. Top portion 52 is connected to base portion 51 by hinge 62. Springs 63 are then attached to top portion 52 and base portion 51 by screws or other means substantially near hinge 62 as shown in FIGS. 7–10. A conventional automatic tuner 70 is built into top portion 52 of the preferred embodiment for tuning the guitar strings.

Finally, four-coil pickup 50 may be inserted into pickup receiving cavity 34 of guitar 21 as shown in FIG. 6. First, lead 64 is threaded through cavity 34 into hollow storage space 36 via the direct communication opening therebetween and inserted into input jack 37. Battery lead 65 and a nine-volt battery (not shown) attached thereto if desired for powering the humbucking preamp of double-coil element 53 are likewise inserted in hollow space 36 (Note, battery lead 65 may be connectable to a power supply wire which is in turn connected to a battery located in compartment 49). Then, base portion S is positioned underneath the guitar strings while pickup 50 is open such that top portion 52 may be rotated down and over the strings as shown in FIG. 8 when closure of four-coil pickup 50 is desired. A further note; four-coil pickup 50 must be constructed such that sufficient space is maintained between top and base portions 51 and 52 so that the guitar strings can vibrate without any physical interference or contact between the strings and four-coil pickup 50.

Practice pickup 72 may alternatively be installed in guitar 21. A practice pickup 72 is shown in FIG. 11 and is preferably a conventional, commercially available, single (or double) coil pickup element that does not require any external power supply. However, practice pickup 72 may be available only in a size that needs to be specially adapted to fit into pickup receiving cavity 34. Such a simple adaptation may include the addition of an aluminum plate (not shown) to the external circumference of practice pickup 72 such that it may be made stationary when placed in pickup receiving cavity 34. Lead 74 is attached to input jack 37 as was described above for lead 64 of four-coil pickup 50.

In use, guitar 21 may be either extended for playing or collapsed for carrying. If fully closed as shown in FIG. 1, the process of opening case assemblage 10 to the position shown in FIG. 6 begins by unlatching hinged clasps 17 and then rotating side portions 11 and 12 away from each other about hinges 20. Guitar 21 may then be slid from the collapsed position shown in FIG. 2 to the extended position shown in FIG. 6 by the process demonstrated in FIG. 3. Specifically, slidable long fretboard member 24 is slid or moved such that neck 27 slides along slide channels 29 outward, emerging from the forward face of first side portion 11 until latch hook 35 engages neck 27. This engagement takes place when fretboard member 24 has been extended to proper playing position. Thus, neck 27 and fretboard member 24 is held so that it cannot slide inwardly or in reverse toward the collapsed or retracted position shown in FIG. 2. Then, removable fastening screws 25 are inserted so as to firmly attach long fretboard member 24 to guitar body 22. Removable short fretboard member 23 is then similarly slid into and along slide channels 29 into proper playing position adjacent fretboard member 24 as shown in FIG. 6. This fretboard member is also held fast to guitar body 22 with fastening screws 25. The insertion of slidable insert 33 and tailpiece bridge 30 as shown in FIG. 3 into channels 29 completes the guitar extension procedure.

The use of removable fastening screws 25 to hold both fretboard members 23 and 24 firmly to guitar body 22 serves the dual purposes of: eliminating any distracting movement of fretboard members 23 and 24 relative to guitar body 22 during play, and increasing what is called "sustain." Sustain is the enhancement of the sounds produced by the vibrating guitar strings because of the resonance through the rigid combination of guitar fretboard members 23 and 24, neck members 26, 27, tailpiece bridge 30, and body 22.

The guitar strings, which are attached to slidable fretboard member 24 and to tailpiece bridge 30, may then be individually tuned by turning knobs 31 in tailpiece 30. It may be advantageous to the tuning process to use built-in tuner 70 of four-coil pickup 50 after this is inserted as described below.

Four-coil pickup 50 may then be inserted for tuning and/or "picking up" the sounds of the string vibrations for generating an electric signal for amplification. Four-coil pickup 50 is placed into pickup receiving cavity 34 in guitar body 22 such that base portion 51 with double-coil element 53 and reverse polarity single-coil element 58 lie underneath and transverse to the guitar strings. When top portion 52 is lowered so that four-coil pickup 50 is "closed," standard polarity single-coil element 57 in top portion 52 lies over and transverse to all the strings as shown in FIG. 8. The guitar strings may then be tuned in the conventional manner with automatic tuner 70 when four-coil pickup 50 is closed.

Further, when lead 64 of four-coil pickup 50 is plugged into input jack 37, and external lead 39 is properly connected so that it delivers the signals from output jack 38 to external amplification as shown in FIG. 14(*a*) (or through mixing board 45, in FIG. 14(*b*)), guitar 21 is ready to play. Again, four-coil pickup 50 has three playing modes. First, when opened as shown in FIG. 7, such that standard polarity coil 57 is lifted up and swung or pivoted away from the strings; a normal, single-coil, electric (without battery power) or a standard humbucking (with battery power) tone and sound level is generated. Or, when simply closed by hand, as described above, a reduced or different tonal (e.g. superclear with bassy or rhythm like) electric amplification is produced by the combined interaction of the reverse polarity magnetic field with the standard polarity field presented by reverse polarity single-coil element 58 and standard single-coil element 57, respectively. Toggling, or switching between these modes (normal electric or humbucking tone to the combination superclear/bassy or rhythm, and vice versa), during guitar play is purposefully and extremely simple and accurate. Specifically, this switching is simply performed by the mere hand pivoting alternation between open and closed positions as described above. Again, the guitar sounds may be diverted to or routed through mixer/amplifier/-sound effects circuitry board 45 to produce altered sounds as is shown in FIG. 14(*b*). Lastly, as an alternative to use of four-coil pickup 50, practice pickup 72 may be inserted into guitar 21 to produce a different electric sound tone or level.

Further, guitar 21 may be played separately or in combination with any one or more of the component elements of sound studio 40 as shown in FIGS. 14(*c*)–(*g*). Or, any one or a combination of the elements of sound studio 40 may also be used apart from guitar (FIGS. 14(*a*) and (*d*)). Thus, guitar 21 may be played along with CD player 41 (FIG. 14(*e*)), cassette tape player/recorder 43 or sound effects board 45, or any combination thereof. Further, guitar 21 may be recorded alone (FIG. 14(*f*)) or while it is played along with CD player 41 (FIG. 14(*g*)) or board 45, or both such that all desired sounds may be recorded on cassette tape player/recorder 43.

To listen to the guitar sounds (or any of the sound studio components, or combinations thereof), stereo headphones or other external amplification (not shown) which are connectable to either any output jack 46 or directly to guitar output jack 38 may be used. When the guitar sounds are diverted through sound effects board 45, the sounds can be altered by adjustment of sound effects control knobs 48 and then output through jacks 46. Switches 47 control which sound studio elements are being output through jacks 46, noting that one or more can be output at a time. Control knobs 48 also include volume control.

Similarly, each of the conventional elements, CD player 41 and tape player/recorder 43 have control buttons 42 and 44, respectively, to control not only volume, but also the various standard functions each such device might have like; play/pause, stop, memory, etc. Each of the sound studio elements is preferably battery powered and such batteries (not shown) are connected to leads contained in compartment 49. Again, humbucking double-coil element 53 also requires battery power, and the nine-volt battery (not shown) used in the preferred embodiment is connected directly to lead 65 or as described above, to a lead routed to a battery contained in compartment 49.

To close guitar case assemblage 10 for carrying, guitar 21 must first be collapsed. To do this, the strings are loosened by turning tuning knobs 31 so that tailpiece bridge 30 and whichever pickup being used, either four-coil pickup 50 or practice pickup 72, can be removed from cavity 34. Tailpiece bridge 30 is then slid out of slide channels 29 toward rearward face 18 of side portion 11, in the opposite direction to that shown in FIG. 3, and four-coil pickup 50 is simply lifted out of pickup receiving cavity 34. Insert 33 may then be slid out toward rearward face 18. Then, removable fastening screws 25 are removed from fretboard members 23 and 24, and removable short fretboard member 23 is slid out of slide channels 29, again by sliding it toward rearward face 18. Short fretboard member 23 and insert 33 are then stored in hollow open storage space 36 as shown in FIG. 4. Then, slidable long fretboard member 24 is similarly slid inwardly along slide channels 29. Tailpiece bridge 30 is also placed in hollow open storage space 36 and slidable fretboard member 24 is slid thereover into fully closed position as shown in FIG. 2. A string holder (not shown) is used in the preferred embodiment to clasp the strings for keeping the strings in a relatively uniform position during closure of assemblage 10. Such a string holder may then be put in pickup receiving cavity 34 under fretboard member 24 to secure the strings for closure of assemblage 10.

Finally, assemblage 10 may be closed by pivoting second side portion 12 about hinge connections 20 into closed position for storage or carrying as shown in FIG. 1. Hinged clasps 17 may then be pivoted such that they attach to hold case assemblage 10 in closed position.

An alternative embodiment of the present invention is depicted in FIG. 12. Shown here is the critical portion of what will be referred to herein as the "Hummingbird" fretboard which is represented by reference numeral 80.

Hummingbird fretboard 80 is substantially similar to the fretboards described above with the exception of the Hummingbird frets, a representative of which is shown here by the reference numeral 8. The principal distinction is that Hummingbird fret 81 has ridges 82, which extend generally transverse to fret 88 and parallel to strings 88, and over which strings 88 rub when guitar 21 is played. First and second ends 83, 84 of fret 81 are shown here for the purpose of assisting the description of the progressively diminishing sizes of ridges 82. Ridges 85 located at or near first end 83 are relatively deep and wide in order to correspond with the thicker guitar strings located at this end. Progressing along fret 81 from first end 83 to second end 84 ridges 82 become thinner and shallower in direct corresponding relationship to guitar strings 88. Finally, ridges 86 at or near second end 84 are the thinnest and shallowest of all ridges 82. Note, all ridges 82 are carefully sized to be sufficiently thin and shallow so as to not allow any corresponding strings 88 to be detrimentally caught or held therewithin and thereby undesirably stop the musical vibrations.

The purpose of ridges 82 is to create a regular physical interference with moving strings 88 such that a buzzing or Hummingbird sound is created Which coacts with the normal guitar string vibrations to artificially generate musical sounds reminiscent of mandolin or violin music. Thus, what becomes an effectively completely different instrument is created by merely replacing fretboard members 23, 24 with interchangeable fretboard 80 in guitar 21. Note, this arrangement is particularly useful with a shorter fretboard (e.g. 22¼ scale) with additional frets (e.g. 29 frets rather than the usual 25).

Hummingbird fretboard 80 is made in substantially the same fashion as fretboard members 23, 24 except for the additional step of using a rotary cutting tool to rout the plurality of ridges 82 in the aluminum frets 81.

As mentioned above, to use Hummingbird fretboard 80, it is first slid into guitar 21 and fastened in place with removable screws 25 in the same manner as described above for fretboard members 23, 24. Then guitar 21 is played in the usual manner, strumming strings 88 with one hand while also fingering strings 88 on the fretboard with the other. Again, the only, yet significant difference is that a distinctive vibratory interference changing the musical tone is created when strings 88 rub on ridges 82.

Other foreseeable embodiments of the present invention include using longer fretboards and/or longer cases and different strings so that guitar 21 would be playable as a bass guitar.

Similarly, shorter or other alternatively shaped fretboards could be used to effectively simulate other stringed instruments. Further, instead of integrating sound studio 40 into side portion 12, a second stringed instrument could be built thereinto. Thus, two differently scaled instruments could be played at the same time.

Finally, four-coil pickup 50 as shown in FIGS. 6–10 is sized to universally fit within existing standardly-sized two-coil instrument cavities (remembering also that pickup 50 could be made to have only single-coil elements so that it would thereby fit only into single-coil cavities). Thus, the advantages of the pivotable pickup switching configuration of pickup 50 can immediately be used in existing solid-body or semi-hollow electric or bass guitars already having (or adaptably routable to have) humbucking or two-coil pickup cavities therein. Hence, the pivotable switching control from the humbucking to the combination of two single-coil elements and vice versa as described herein is foreseeably useful with any electric guitar. One other note, four-coil pickup 50 is foreseeably adaptable to be useful in acoustic or hollow body guitars as well because as described, it is also sized to fit standard acoustic cavities and there is sufficient space available in top portion 52 to house one or more conventional acoustic pickups (or microphones) that may be connectable to the contact switches described above. Thus, pickup 50 would be inserted in an acoustic guitar cavity and would be activated to pickup the guitar sounds upon pivotable closure of top portion 52 down, over the guitar strings and base portion 51 as described above.

From the foregoing, it is readily apparent that a useful embodiment of the present invention has been herein described and illustrated which fulfills all of the aforestated objectives in a remarkably unexpected fashion. It is, of course, understood that such modifications, alterations, and adaptations as may readily occur to the artisan confronted with this disclosure are intended within the spirit of this disclosure which is limited only by the scope of the claims appended hereto.

Accordingly, what is claimed is:

1. A guitar case assemblage comprising:

a. first and second side portions, b. a collapsible guitar, including conventional guitar strings, formed integrally within said first side portion of said case assemblage, and c. a sound studio formed within said second side portion of said case assemblage.

2. A guitar case assemblage according to claim 1 in which said collapsible guitar comprises interchangeable, slidable fretboards that slide completely within said case assemblage for closure of said case assemblage.

3. A guitar case assemblage according to claim 2 in which said slidable fretboards move from open to closed position, and vice versa, through means of slide channels built into said collapsible guitar and said slidable fretboards have flanges which correspondingly fit in said slide channels.

4. A guitar case assemblage according to claim 2 in which at least one of said interchangeable slidable fretboards comprises "Hummingbird" frets having ridges cut therein for producing an alternative vibratory sound when said guitar strings rub thereon during guitar play.

5. A guitar case assemblage according to claim 4 in which said frets have ridges that progressively decrease in size and shape in direct correspondence to the size and shape of said guitar strings.

6. A guitar case assemblage according to claim 1 in which said sound studio comprises:

a. a compact disc (CD) player;

b. a cassette tape player/recorder; and c. a circuitry board having special sound effects capabilities.

7. A guitar case assemblage according to claim 6 further comprising interchangeable, removable pickups for picking up guitar sounds and converting or transducing said guitar sounds into electric signals for electric amplification.

8. A guitar case assemblage according to claim 7 further comprising a removable pickup configuration having multiple pickup elements and having a top portion and a base portion connected by a hinge for picking up guitar sounds for electric amplification at a plurality of different tones or pitches by converting or transducing said guitar sounds into electric signals, and for simply toggling or switching between said different tones or pitches during guitar play by simple rotation of said top portion relative to said base portion about said hinge.

9. A guitar case assemblage according to claim 1 further comprising interchangeable, removable pickups for picking up guitar sounds and converting or transducing said guitar sounds into electric signals for electric amplification.

10. A guitar case assemblage according to claim 9 further comprising a removable pickup configuration having multiple pickup elements and having a top portion and a base portion connected by a hinge for picking up guitar sounds for electric amplification at a plurality of different tones or pitches by converting or transducing said guitar sounds into electric signals, and for simply toggling or switching between said different tones or pitches during guitar play by simple rotation of said top portion relative to said base portion about said hinge.

11. A guitar case assemblage according to claim 10 in which said pickup configuration further comprises a plurality of switching mechanisms having at least two electrical leads per switching mechanism one each connected at one end thereof to a corresponding one of said pickup elements and one each at the other end thereof connected to a conductive contact member and a conductive spring member, respectively such that said rotation of said top portion relative to said base portion about said hinge provides alternately contact and no contact between said conductive contact and spring members to further provide alternately an electrical connection and no electrical connection between said pickup elements for switching between said different tones or pitches.

12. A guitar case assemblage according to claim 11 in which one of said pickup elements is a double-coil humbucking pickup element.

13. 1. A guitar case assemblage according to claim 11 in which one of said pickup elements is a single-coil reverse polarity pickup element.

14. A guitar case assemblage according to claim 13 in which said single-coil reverse polarity pickup element is connected via said switching mechanism to another of said pickup elements to alternately produce a standard output signal and a combined power and tone output signal.

15. A collapsible guitar comprising a guitar body having first and second slide channels defined therein in spaced generally parallel relationship to each other, conventional guitar strings, and interchangeable slidable fretboards having flanges which correspondingly fit in said slide channels so that said slidable fretboards move from open to closed position, and vice versa, by sliding within said slide channels in said guitar body for extending or collapsing said collapsible guitar.

16. A collapsible guitar according to claim 15 further comprising interchangeable, removable pickups for picking up guitar sounds and converting said guitar sounds into electric signals for electric amplification.

17. A collapsible guitar according to claim 15 further comprising a removable pickup configuration having multiple pickup elements and having a top portion and a base portion connected by a hinge for picking up guitar sounds for electric amplification at a plurality of different tones or pitches by converting said guitar sounds into electric signals, and for simply toggling or switching between said different tones or pitches during guitar play by simple rotation of said top portion relative to said base portion about said hinge.

18. A collapsible guitar according to claim 15 in which said pickup configuration further comprises a plurality of switching mechanisms having at least two electrical leads per switching mechanism one each connected at one end thereof to a corresponding one of said pickup elements and one each at the other end thereof connected to a conductive contact member and a conductive spring member, respectively such that said rotation of said top portion relative to said base portion about said hinge provides alternately contact and no contact between said conductive contact and spring members to further provide alternately an electrical connection and no electrical connection between said pickup elements for switching between said different tones or pitches.

19. A collapsible guitar according to claim 15 in which at least one of said interchangeable slidable fretboards comprises "Hummingbird" frets having ridges cut therein for producing an alternative vibratory sound when said guitar strings rub thereon during guitar play.

20. A collapsible guitar according to claim 15 in which said frets have ridges that progressively decrease in size and shape in direct correspondence to the size and shape of said guitar strings.

21. A removable pickup configuration for use with electrical stringed instruments, said pickup configuration comprising a plurality of pickup elements, a top portion, a base portion and a hinge, said top portion and said bottom portion each containing one or more of said pickup elements, said top portion being pivotally connected to said base portion by said hinge and being operably rotatable relative thereto.

22. A pickup configuration according to claim 21 which includes a switching mechanism having a conductive contact member, a conductive spring member and at least two electrical leads; one of said electrical leads operatively connects one pickup element in one of said portions with said conductive contact member and another of said electrical leads operatively connects one pickup element in the other of said portions with said conductive spring member, where upon the operable rotation of said top portion relative to said base portion about said hinge, said conductive contact member alternately engages and disengages said conductive spring member to alternately open and close an electrical connection between said pickup elements.

* * * * *